US006135725A

United States Patent [19]

Chou

[11] Patent Number: 6,135,725

[45] Date of Patent: Oct. 24, 2000

[54] VALVED PISTON ARRANGEMENT FOR AN ELECTRIC MOTOR DRIVEN AIR COMPRESSOR

[76] Inventor: Wen-San Chou, P.O. Box 82-144, Taipei, Taiwan

[21] Appl. No.: 09/203,506

[22] Filed: Dec. 1, 1998

Related U.S. Application Data

[63] Continuation-in-part of application No. 08/712,187, Sep. 11, 1996, Pat. No. 5,655,887.

[51] Int. Cl.[7] ..... F04B 35/00

[52] U.S. Cl. ..... 417/360; 417/415; 417/569

[58] Field of Search ..... 417/360, 368, 417/415, 552, 553, 569

[56] References Cited

U.S. PATENT DOCUMENTS

| | | | |
|---|---|---|---|
| 1,470,548 | 10/1923 | Spopher | 417/415 |
| 2,265,971 | 12/1941 | Paul et al. | 417/553 |
| 4,023,467 | 5/1977 | Thurmer | 417/552 |
| 4,551,074 | 11/1985 | Asaka et al. | 417/415 |
| 5,215,447 | 6/1993 | Wen | 417/415 |

*Primary Examiner*—Charles G. Freay
*Attorney, Agent, or Firm*—A & J

[57] ABSTRACT

A valved piston arrangement for an electric motor driven air compressor includes a motor provided with an output shaft having a semi-cylindrical portion at an outer end thereof, a mount formed with a vertical cylinder and a downwardly extending lug, a transmission mechanism including a circular body and a counterweight fitted in the circular body, and a compression mechanism mounted inside the cylinder and coupled to a coupling rod through a link, whereby the valved piston arrangement for an electric motor driven air compressor can achieve high performance and can draw in air to cool the motor in operation.

1 Claim, 4 Drawing Sheets

VALVED PISTON ARRANGEMENT FOR AN ELECTRIC MOTOR DRIVEN AIR COMPRESSOR

CROSS-REFERENCE

This invention is a continuation-in-part of application Ser. No. 08/712,187, filed Sep. 11, 1996, now U.S. Pat. No. 5,655,887, owned by the same applicant.

BACKGROUND OF THE INVENTION

1. Field of the Invention

This invention is related to a valved piston arrangement for an electric motor driven air compressor.

2. Description of the Prior Art

FIG. 4 shows a conventional air compressor, which comprises a motor 5, a securing plate 6, a transmission gear 7, a compression cylinder 8, and a connecting disk 9. The motor 5 and securing plate 6 are screwably locked together by bolts 50. A guide gear 51 is fixedly provided at the spindle of the motor 5. The horizontal end of the securing plate 6 is formed with a cylinder hole 60 and a plurality of screw holes 61. The vertical end of the securing plate 60 is provided with upper and lower gear holes 62, 63. The upper gear hole 62 allows the passage of a spindle of the guide gear 51 of the motor, whereas the lower gear hole 63 receives a connecting tube 64 and one end of a spindle of the transmission gear 7. A C-clip 65 is used to fasten them in place. Reinforcing ribs 66 are disposed at the joint between the vertical end and horizontal end of the securing plate 6. At the same time, the transmission gear 7 is provided on the securing plate 6 and engages the guide gear 51. One end of the transmission gear 7 is provided with a weight 70. The other end thereof has a connecting rod 71 extending therefrom. The connecting rod 71 is pivotally connected to the bottom of a link 80. The top end of the link 80 is pivotally connected to a piston 82 by means of a shaft 81. The top end of the piston 82 is fitted with a compression block 83 and a ring 84 in sequence. By means of a through lower air hole 85, the top portion of the compression block 83 may be coupled to a packing piece 86 and movably connected with a cover plate 87 assembled into the compression cylinder 8, whereby the compression cylinder 8 may generate a pushing force due to rotation of the motor 5. Furthermore, the upper end of the compression cylinder 8 is connected to the connecting disk 9, which is peripherally provided with a plurality of connecting elements 90. Bolts 91 are passed through round holes 92 of the connecting elements 90 and the screw holes 61 of the securing plate 6 to lock the connecting disk 9, the compression cylinder 8, and the securing plate 6 as a whole. The connecting disk 9 is further provided with an upper air hole 93 which is connected to a packing piece 94 and a cover plate 95. The upper air hole 93 cooperates with the lower air hole 85 of the the piston 82 to achieve the drawing in and discharge of air, the air being output from a guide tube 96 connected to one end of the connecting disk 9.

As can be seen, the conventional air compressor is very complicated in structure and assembly thereof is also difficult. The drawbacks of conventional air compressors are summed up as follows:

1. Air discharge control effects achieved by utilizing displacement of the ring 84 of the compression block 83 inside the compression cylinder 8 are not complete.

2. Assembly is inconvenient and troublesome as the link 80 is coupled to the piston 82 by means of the shaft 81 and the upper end of the piston 82 has the compression block 83 and the ring 84 fitted thereon. And besides, manufacturing costs are relatively high and production speed low.

3. As the securing plate 6 and the compression cylinder 8 are coupled in a separated manner, manufacture of the air compressor is made difficult. Additionally, the securing plate 6 cannot constitute a preferred structure in which the fulcrum is located between the point of force application and the point of resistance.

4. As the transmission gear is provided with a weight, the load borne by the gear from rotation to air intake is relatively large, so that the friction coefficient between pitches increases, which may damage the transmission gear and affect intake and output air pressure.

5. It is necessary to mount an additional fan on the end of the motor to cool the motor, but the power cords at the end of the motor will be easily damaged by the blades of the fan.

Therefore, it is an object of the present invention to provide a valved piston arrangement for an electric motor driven air compressor which can obviate and mitigate the above-mentioned drawbacks.

SUMMARY OF THE INVENTION

This invention is related to a valved piston arrangement for an electric motor driven air compressor which generally includes a motor provided with an output shaft having a semi-cylindrical portion at an outer end thereof, a mount formed with a vertical cylinder and a downwardly extending lug, a transmission mechanism including a circular body and a counterweight fitted in the circular body, and a compression mechanism mounted inside the cylinder and coupled to a coupling rod through a link.

It is the primary object of the present invention to provide a valved piston arrangement for an electric motor driven air compressor which achieves high performance.

It is another object of the present invention to provide a valved piston arrangement for an electric motor driven air compressor which can draw in air to cool the motor in operation.

The invention is naturally not limited in any sense to the particular features specified in the foregoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

DETAILED DESCRIPTION OF THE PREFERRED EMBODIMENT

Figure 1:
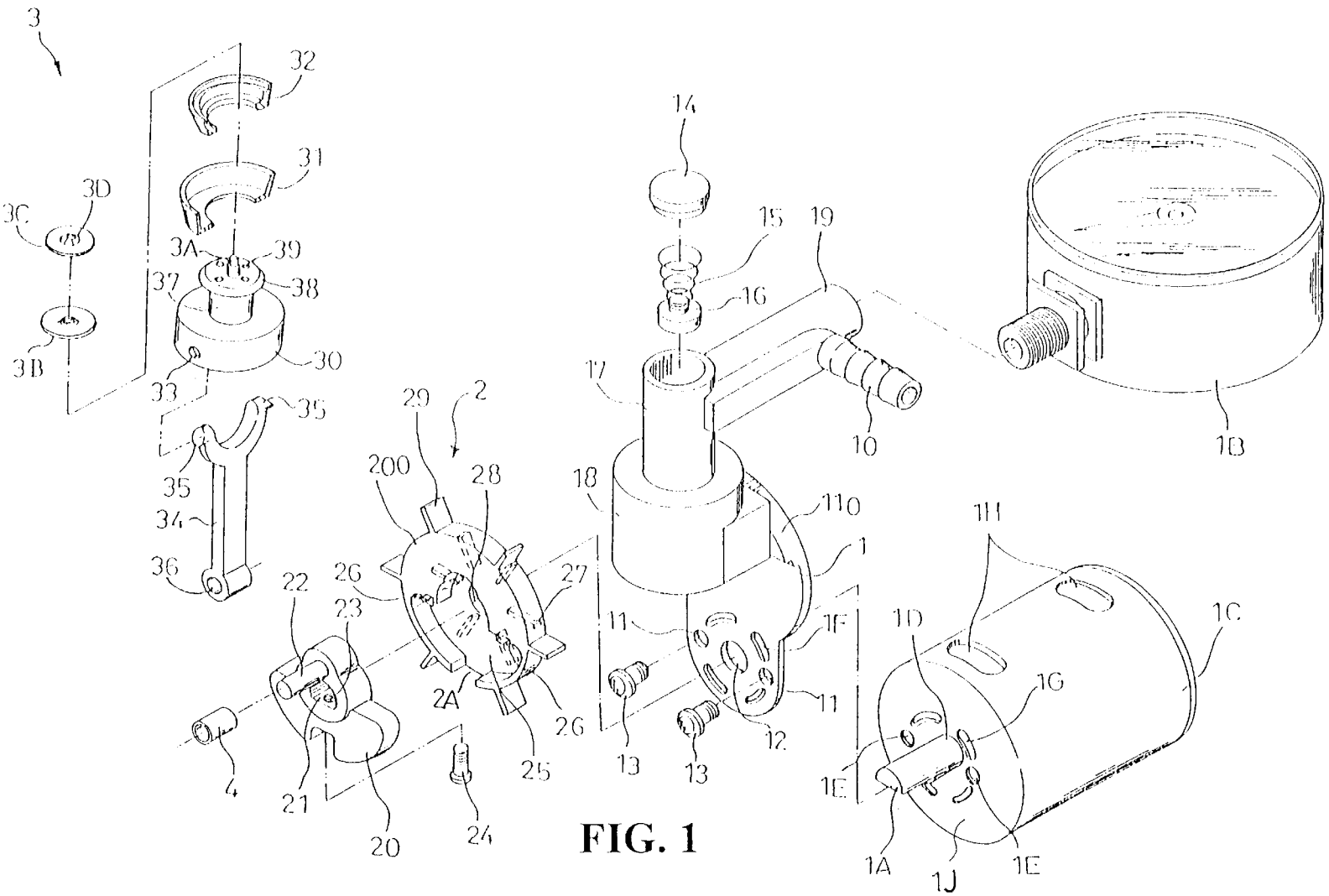
FIG. 1 is an exploded view of the present invention.
Figure 2:
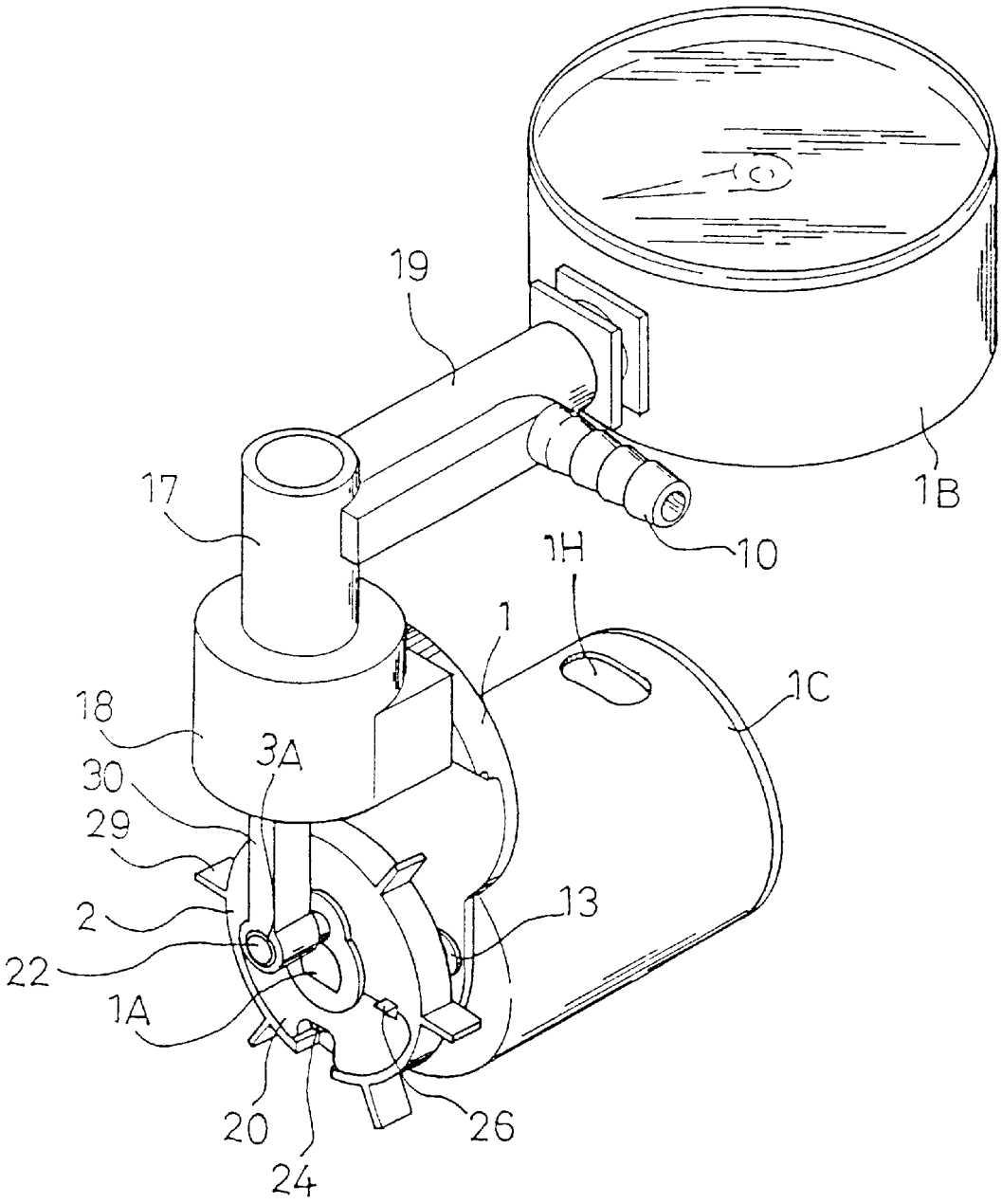
FIG. 2 is a perspective view of the present invention.
Figure 3:
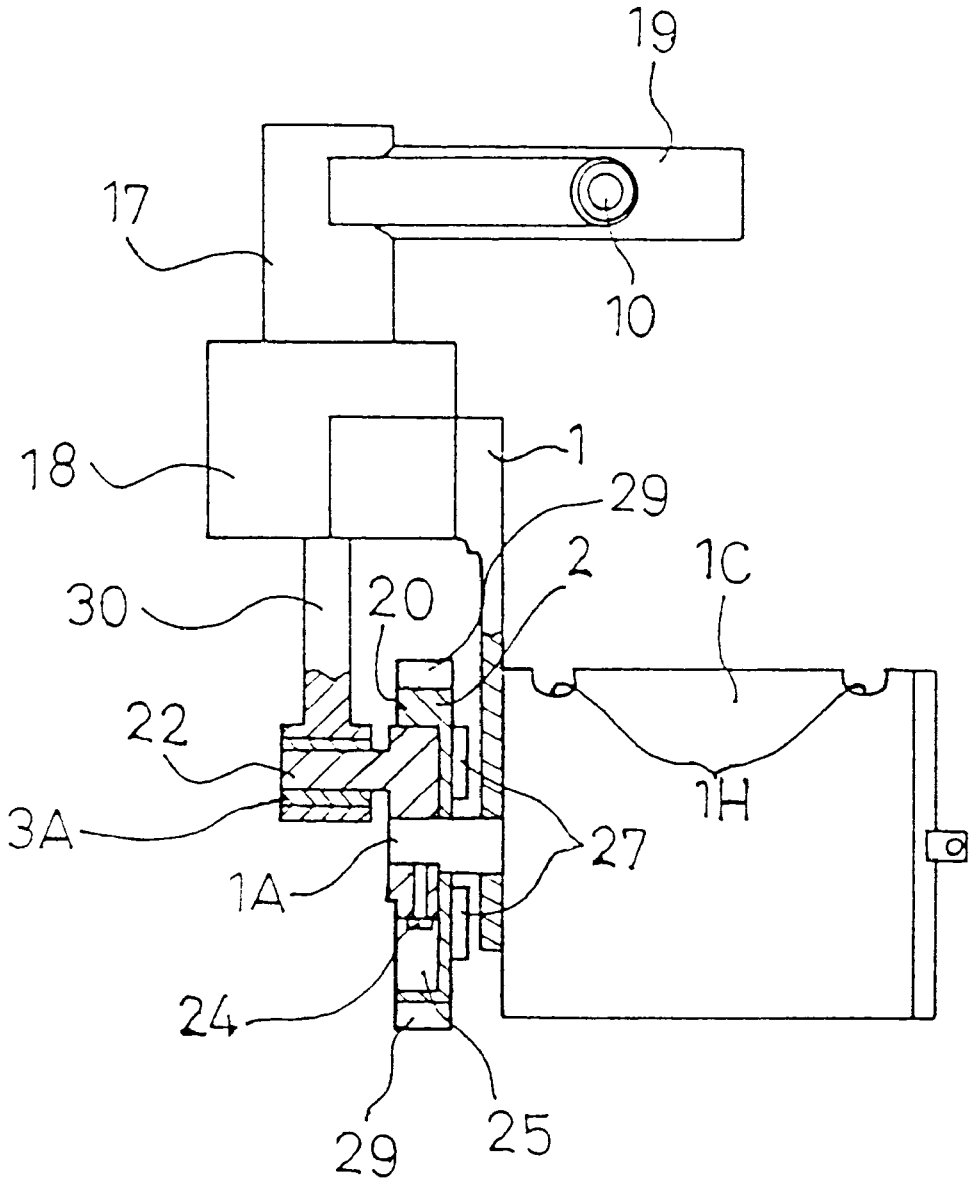
FIG. 3 is a sectional view of the present invention.
Figure 4:
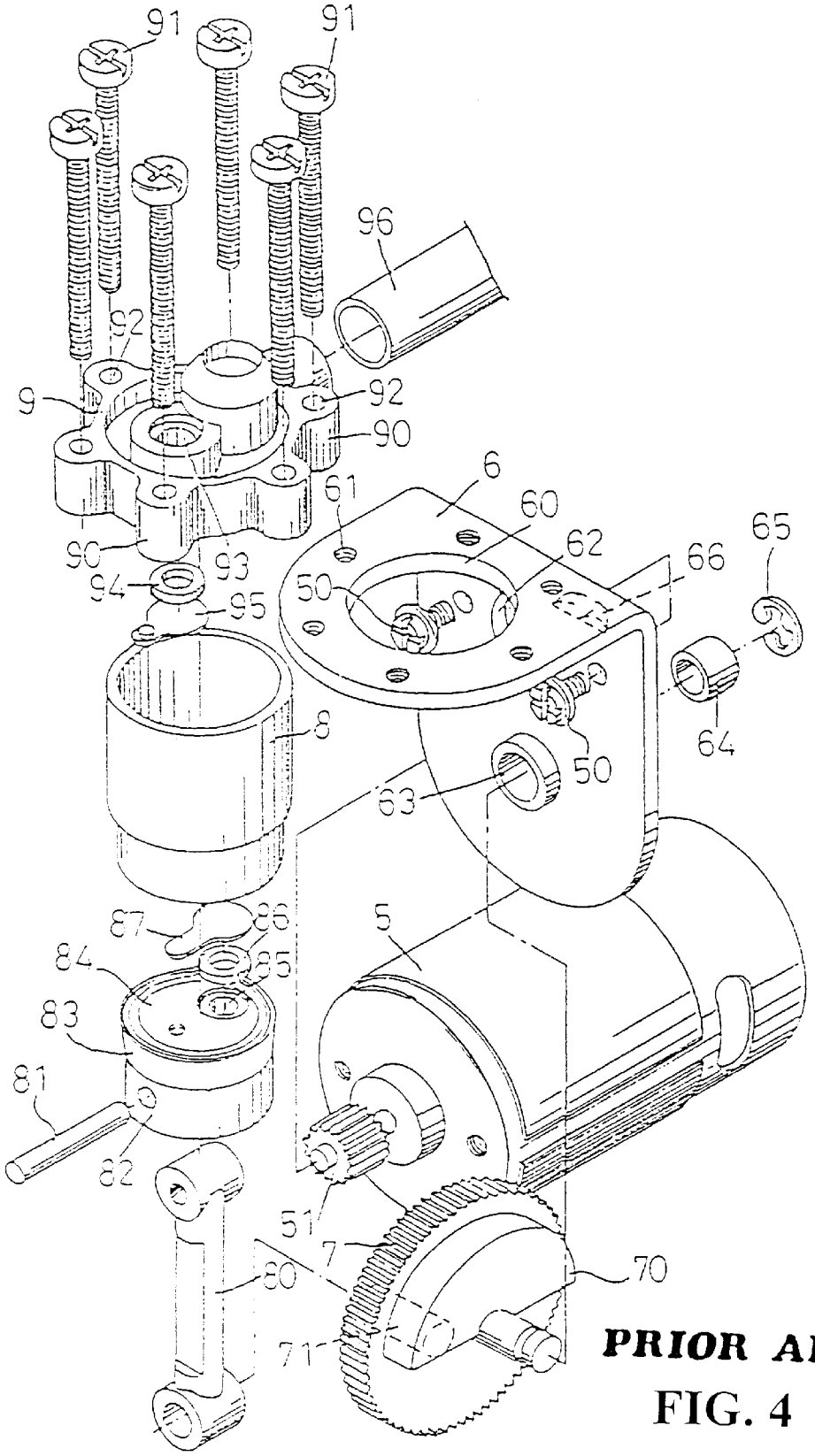
PRIOR ART FIG. 4
FIG. 4 is an exploded view of a prior art air compressor.

With reference to the drawings and in particular to FIGS. 1, 2 and 3 thereof, the present invention generally comprises a motor 1C, a mount 1, a transmission mechanism 2 and a compression mechanism 3.

The motor 1C is provided with an output shaft 1D having a semi-cylindrical portion 1A at an outer end thereof. The inner side of the motor 1C is formed with a plurality of slots 1G and two threaded holes 1E, while the top of the motor 1C has a plurality of openings 1H.

The mount 1 is an integral member formed with a vertical cylinder 18 and a downwardly extending lug 110. The vertical cylinder 18 has an upright stub tube 17 sealed by a cap 14 which holds a spring 17 inside the upright stub tube 17 and an exhaust valve block 16 at the bottom of the spring 17. A guide tube 10 and a coupling tube 19 are respectively and perpendicularly connected to the upright stub tube 17. The guide tube 10 is for output of compressed air. A pressure gauge 1B is connected to the coupling tube 19 to detect the value of air pressure. The lug 110 has a plurality of slots 1F aligned with the slots 1G of the motor 1C, two holes 11 aligned with the two threaded holes 1E, and a center hole 12 dimensioned to receive the output shaft 1D of the motor 1C.

The transmission mechanism 2 includes a circular body 200 and a counterweight 20 fitted in the circular body 200. The circular body 200 is formed with a recess 25 at one side thereof and a notch 2A in communication with the recess 25. Two stoppers 26 are provided at two opposite sides of the recess 25. The circular body 200 is provided with a plurality of blades 29 around its circumferential edge and a plurality of baffles 27 on another side thereof. The counterweight 20 is configured to fit into the recess 25 of the circular body 200 so that the counterweight 20 is kept in place by the two stoppers 26. The counterweight 20 is formed with a semi-circular opening 21 at the central portion adapted to receive the semi-cylindrical portion 1A of the output shaft 1D of the motor 1C and a coupling rod 22 arranged eccentrically above the semi-circular opening 21. A bushing 4 is fitted over the coupling rod 22. The semi-circular opening 21 has a vertical threaded through hole 23 so that the output shaft 1D of the motor 1C can be fixedly mounted on the counterweight 20 by a screw 24.

The compression mechanism 3 is mounted inside the cylinder 18 and coupled to the coupling rod 22 through a link 34. The link 34 has a barrel 36 at one end coupled to the coupling rod 22 of the counterweight 20, and two reversed coupling rods 35 at an opposite end. The compression mechanism 3 comprises a base 30, a compressible conical piston 32, and a conical piston holder 31. The base 30 comprises two coupling holes 33 bilaterally disposed at the bottom and respectively coupled to the reversed coupling rods 35 of the link 34, a coupling bolt 37 raised from the top and having a head 38 at the top, a retainer rod 3A raised from the center of the head 38, a plurality of axial air holes 39 through the coupling bolt 37 and the base 30, a valve flap 3B slidably mounted around the retainer rod 3A, and a cap 3C having a coupling portion 3D at the center coupled to the retainer rod 3A above the valve flap 3B.

As shown in FIG. 2, when the motor 1C is turned on, the output shaft 1D of the motor 1C will rotate the counterweight 20 and the circular body 200. As the coupling rod 22 of the counterweight 20 is disposed at an eccentric location, when the counterweight 20 is turned with the shaft 1D, the link 34 is driven by the coupling rod 22 of the counterweight 20 to reciprocate the base 30 of the compression mechanism 3, thereby causing the pistion 32 and the piston holder 31 to be simultaneously reciprocated in the cylinder 18. When the piston 32 is moved downwards, outside air is guided into the inside space of the cylinder 18 through the axial air holes 39. On the contrary, when the piston 32 is moved upwards, the axial air holes 39 are blocked by the valve flap 3B, and the exhaust valve block 19 is forced upwards to open the air passage between the cylinder 17 and the guide tube 10, permitting compressed air to flow out of the cylinder 18 through the guide tube 10, and at the same time compressed air is partially guided to the pressure gauge 1B to indicate the value of compressed air. When the circular body 200 is rotated, the blades 29 and baffles 27 of the circular body 200 will force air to flow through the motor 1C by means of the slots 1F and 1E and openings 1H thereby cooling the motor 1C.

The invention is naturally not limited in any sense to the particular features specified in the foregoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A valved piston arrangement for an electric motor driven air compressor comprising:

a motor provided with an output shaft having a semi-cylindrical portion at an outer end thereof, a side of said motor being formed with a plurality of first slots and two threaded holes, a top of said motor having a plurality of openings;

a mount formed with a vertical cylinder and a downwardly extending lug, said vertical cylinder having an upright stub tube sealed by a cap which holds a spring inside said upright stub tube and an exhaust valve block at a bottom of said spring, a guide tube and a coupling tube being respectively and perpendicularly connected to said upright stub tube, said lug having a plurality of second slots aligned with said first slots, two holes aligned with said two threaded holes, and a center hole dimensioned to receive said output shaft;

a transmission mechanism including a circular body and a counterweight fitted in said circular body, said circular body being formed with a recess at one side thereof and a notch in communication with said recess, two stoppers being provided at two opposite sides of said recess, said circular body being provided with a plurality of blades around a circumferential edge thereof and a plurality of baffles on another side thereof, said counterweight being configured to fit into said recess so that said counterweight is kept in place by said two stoppers, said counterweight being formed with a semi-circular opening at a central portion adapted to receive said semi-cylindrical portion and a coupling rod arranged eccentrically above said semi-circular opening, said semi-circular opening having a vertical threaded through hole engageable with a screw; and a compression mechanism mounted inside said cylinder and coupled to said coupling rod through a link, said link having a barrel at one end coupled to said coupling rod and two reversed coupling rods at an opposite end thereof, said compression mechanism comprising a base, a compressible conical piston, and a conical piston holder, said base comprising two coupling holes bilaterally disposed at a bottom and respectively coupled to said reversed coupling rods, a coupling bolt raised from a top and having a head at the top, a retainer rod raised from a center of said head, a plurality of axial air holes through said coupling bolt and said base, a valve flap slidably mounted around said retainer rod, and a cap having a coupling portion at a center coupled to said retainer rod above said valve flap.

* * * * *